US005972288A

United States Patent [19]

Jeong et al.

[11] Patent Number: 5,972,288

[45] **Date of Patent: *Oct. 26, 1999**

[54] COMPOSITION OF ZIRCONIUM ALLOY HAVING HIGH CORROSION RESISTANCE AND HIGH STRENGTH

[75] Inventors: Yong Hwan Jeong; Jong Hyuk Baek; Byong Kwon Choi; Kyeong Ho Kim; Sun Jae Kim; Youn Ho Jung; Il Hiun Kuk, all of Taejon-si, Rep. of Korea

[73] Assignees: Korea Atomic Energy Research Institute, Taejon-si; Korea Electric Power Corporation, Seoul, both of Rep. of Korea

[ * ] Notice: This patent is subject to a terminal disclaimer.

[21] Appl. No.: 09/096,659

[22] Filed: Jun. 12, 1998

[30] Foreign Application Priority Data

Feb. 4, 1998 [KR] Rep. of Korea ..... 98-3134

[51] Int. Cl.[6] ..... C22C 16/00

[52] U.S. Cl. ..... 420/422; 148/421; 420/423

[58] Field of Search ..... 148/421; 420/422, 420/423

[56] References Cited

U.S. PATENT DOCUMENTS

| | | | |
|---|---|---|---|
| 4,879,093 | 11/1989 | Garde | 420/422 |
| 4,938,920 | 7/1990 | Garzarolli et al. | 376/457 |
| 5,017,336 | 5/1991 | Matsuo et al. | 420/422 |
| 5,080,861 | 1/1992 | Garde | 420/422 |
| 5,196,163 | 3/1993 | Matsuo et al. | 420/422 |
| 5,241,571 | 8/1993 | Pati et al. | 376/260 |
| 5,278,882 | 1/1994 | Garde et al. | 376/416 |
| 5,334,345 | 8/1994 | Rudling | 420/422 |

*Primary Examiner*—John Sheehan
*Attorney, Agent, or Firm*—Dilworth & Barrese

[57] ABSTRACT

The invention presented herein relates to a zirconium alloy with superior corrosion resistance and high strength for use in fuel rod claddings, spacer grids and structural components as used in reactor core of light water and heavy water nuclear power plant. The zirconium alloy of this invention with superior corrosion resistance and high strength comprises an alloy composition as follows:

niobium(Nb), in a range of 0.05 to 0.3 wt. %;

tin(Sn), in a range of 0.8 to 1.6 wt. %;

iron(Fe), in a range of 0.2 to 0.4 wt. %;

a selected one from the group consisted of vanadium(V), tellurium(Te), antimony(Sb), molybdenum(Mo), tantalum(Ta), and copper(Cu), in a range of 0.05 to 0.20 wt. %;

oxygen(O), in a range of 600 to 1400 ppm; and the balance being zirconium(Zr).

4 Claims, No Drawings

COMPOSITION OF ZIRCONIUM ALLOY HAVING HIGH CORROSION RESISTANCE AND HIGH STRENGTH

BACKGROUND OF THE INVENTION

The invention presented herein relates to the composition of zirconium (Zr) alloy having a superior corrosion resistance and high strength. In particular, this invention relates to the alloys with superior corrosion resistance and high strength for fuel claddings, spacer grids, and core structural components in light water reactor (LWR) and heavy water reactor (HWR).

Zirconium alloys, in particular Zircaloy-2 and Zircaloy-4, have been widely used as fuel rod cladding and structural elements of nuclear reactor core.

The development of zirconium alloys is illustrated as follows: Zircaloy-1 (Sn: 2.5 wt. %, Zr: the balance); Zircaloy-2 (Sn: 1.20–1.70 wt. %, Fe: 0.07–0.20 wt. %, Cr: 0.05–1.15 wt. %, Ni: 0.03–0.08 wt. %, O: 900–1500 ppm, Zr: the balance; wherein, Fe+Cr+Ni: 0.16–1.70 wt. %); Zircaloy-3A (Sn: 2.5 wt. %, Fe: 0.25 wt. %, Zr: the balance); Zircaloy-3B (Sn: 0.5 wt. %, Fe: 0.4 wt. %, Zr: the balance); Zircaloy-3C (Sn: 0.5 wt. %, Fe: 0.2 wt. %, Ni: 0.2 wt. %, Zr: the balance); Zircaloy-4 (Sn: 1.20–1.70 wt. %, Fe: 0.18–0.24 wt. %, Cr: 0.07–0.13 wt. %, O: 900–1500 ppm, Ni: <0.07 wt. %, Zr: the balance, wherein Fe+Cr: 0.28–0.24 wt. %); and so forth. The above alloys, except for Zircaloy-2 and Zircaloy-4, have not been commercialized due to poor mechanical strength and corrosion resistance in the reactor.

As the operating conditions of nuclear power plants tend to be at high burnup, increased operating temperature, and high pH, Zircaloys could not be utilized as fuel rod cladding. Recently, the extensive and successful research and development have been focused on increasing the corrosion resistance of zirconium alloys.

U.S. Pat. No. 5,254,308 discloses the alloy in which niobium and iron were added to maintain mechanical properties. This alloy comprises tin in the range of 0.45 to 0.75 wt. % (typically 0.6 wt. %); iron in the range of 0.4 to 0.53 wt. % (typically 0.45 wt. %); chromium in the range of 0.2 to 0.3 wt. % (typically 0.25 wt. %); niobium in the range of 0.3 to 0.5 wt. % (typically 0.45 wt. %); nickel in the range of 0.012 to 0.03 wt. %(typically 0.02 wt. %) silicon in the range of 50 to 200 ppm (typically 100 ppm); oxygen in the range of 1000 to 2000 ppm (typically 1600 ppm); and the balance being zirconium, wherein the ratio of iron to chromium (Fe/Cr) was 1.5. The amount of niobium was relatively fixed to that of iron which has effects on the hydrogen uptake. Also, the amount of nickel, silicon, carbon, and oxygen were fixed to maintain the superior corrosion resistance and high strength.

U.S. Pat. No. 5,278,882 also describes the zirconium alloy without niobium which comprises tin in the range of 0.4 to 1.0 wt. % (typically 0.5 wt. %); iron in the range of 0.3 to 0.6 wt. % (typically 0.46 wt. %); chromium in the range of 0.2 to 0.4 wt. % (typically 0.23 wt. %); nickel in the range of 0.012 to 0.03 wt. % (typically 0.02 wt. %); silicon in the range of 50 to 200 ppm (typically 100 ppm); oxygen in the range of 1200 to 2500 ppm (typically 1800 ppm); and the balance being zirconium.

U.S. Pat. No. 5,334,345 discloses the zirconium alloy, which improves corrosion and hydrogen uptake resistance, as follows:

tin, in the range of 1.0 to 2.0 wt. %;

iron, in the range of 0.07 to 0.70 wt. %;

chromium, in the range of 0.05 to 0.15 wt. %;

nickel, in the range of 0.16 to 0.40 wt. %;

niobium, in the range of 0.015 to 0.30 wt. % (typically in the range of 0.015 to 0.20 wt. %);

silicon, in the range of 0.002 to 0.05 wt. % (typically in the range of 0.015 to 0.05 wt. %);

oxygen, in the range of 900 to 1600 ppm; and zirconium, the balance.

U.S. Pat. No. 5,366,690 describes the another zirconium alloy in which the amounts of tin, nitrogen and niobium were each controlled, containing tin in a range of 0 to 1.50 wt. % (typically 0.6 wt. %); iron in a range of 0 to 0.24 wt. % (typically 0.12 wt. %); chromium in a range of 0 to 0.15 wt. % (typically 0.10 wt. %); nitrogen in a range of 0 to 2300 ppm; silicon in a range of 0 to 100 ppm (typically 100 ppm); oxygen in a range of 0 to 1200 ppm (typically 1200 ppm); and niobium in a range of 0 to 0.5 wt. % (typically 0.45 wt. %).

U.S. Pat. Nos. 4,863,685; 4,986,975; 5,024,809; and 5,026,516 relate to the zirconium alloy with tin (0.5–2.0 wt. %), other alloying elements (0.5–1.0 wt. %), and oxygen (0.09–0.16 wt. %). In the alloy according to the U.S. Pat. No. 4,863,685, the other alloying elements are molybdenum, tellurium, the mixture thereof, Nb-Te, or Nb-Mo. The amounts of copper, nickel, and iron were limited to the range of 0.24 to 0.40 wt. %, and copper was added more than 0.05 wt. %. In U.S. Pat. Nos. 5,024,809 and 5,026,516, alloying elements are added in the range of 0.5 to 1.0 wt. % which is the same as that in U.S. Pat. No. 4,863,685. Bismuth(Bi) or (Bi+Sn) is added to this alloy, and the other alloying elements are molybdenum, niobium, and tellurium.

U.S. Pat. No. 4,938,920 discloses the improved Zircaloy-4 with better corrosion resistance in which tin was reduced to the range of 0 to 0.8 wt. %, and vanadium in a range of 0 to 0.3 wt. % and niobium in a range of 0 to 1 wt. % was added. This alloy includes iron in a range of 0.2 to 0.8 wt. %, chromium in a range of 0 to 0.4 wt. %, and oxygen in a range of 1000 to 1600 ppm. The amount of (Fe+Cr+V) was also limited to a range of 0.25 to 1.0 wt. %. When this alloy was tested in autoclave at 400° C. to measure the corrosion resistance, the weight gain of the alloy with a composition of 0.8Sn-0.22Fe-0.11Cr-0.14O; 0.4Nb-0.67Fe-0.33Cr-0.15O; 0.75Fe-0.25V-0.1O; and 0.25Sn-0.2Fe-0.15V-0.1O decreased down to about 60% weight gain of compared to Zircaloy-4, and the tensile strength of these alloys was the same as that of Zircaloy-4.

U.S. Pat. No. 4,981,527 discloses an advanced zirconium alloy with high uniform and nodular corrosion resistance, which comprises an alloy composition as follows:

iron, in a range of 0.1 to 0.35 wt. %;

vanadium, in a range of 0.07 to 0.4 wt. %;

oxygen, in a range of 0.05 to 0.3 wt. %;

silicon, less than 0.25 wt. %;

niobium, less than 0.25 wt. %; and zirconium, the balance.

The amounts of (Fe+V) are fixed at less than 0.75 wt. % to improve the workability in the process of cold working. The amounts of niobium and tin were limited in accordance with corrosion tests, and oxygen was added to improve hardness and creep resistance. This alloy has high uniform and nodular corrosion resistance in the same metallurgical conditions.

U.S. Pat. No. 4,963,323 describes the improved Zircaloy-4 in which the composition is adjusted for use in fuel rod cladding with high corrosion resistance. In this alloy, the amount of tin was decreased, niobium was added to compensate for the decreased tin, and nitrogen was limited to less than 60 ppm. Thus, the improved Zircaloy-4 according to U.S. Pat. No. 4,963,323 comprised tin in a range of 0.2 to 1.15 wt. %, iron in a range of 0.19 to 0.6 wt. % (typically 0.19 to 0.24 wt. %), chromium in a range of 0.07 to 0.4 wt. % (typically 0.07 to 0.13 wt. %), niobium in a range of 0.05 to 0.5 wt. %, and nitrogen up to 60 ppm.

U.S. Pat. No. 5,017,336 discloses the improved Zircaloy-4 which was adjusted by adding with niobium, tantalum, vanadium, and molybdenum, and the alloy composition is as follows:

tin, in a range of 0.2 to 0.9 wt. %;

iron, in a range of 0.18 to 0.6 wt. %;

chromium, in a range of 0.07 to 0.4 wt. %;

niobium, in a range of 0.05 to 0.5 wt. %;

tantalum, in a range of 0.01 to 0.2 wt. %;

vanadium, in a range of 0.05 to 1 wt. %;

molybdenum, in a range of 0.05 to 1 wt. %; and the balance being zirconium.

U.S. Pat. No. 5,196,163 discloses the improved zirconium alloy containing tantalum and niobium as well as the usual composition which are tin, iron and chromium. The alloy composition is as follows:

tin, in a range of 0.2 to 1.15 wt. %;

iron, in a range of 0.19 to 0.6 wt. % (typically 0.19 to 0.24 wt. %);

chromium, in a range of 0.07 to 0.4 wt. % (typically 0.07 to 0.13 wt. %);

tantalum, in a range of 0.01 to 0.2 wt. %;

niobium, in a range of 0.05 to 0.5 wt. %;

nitrogen, less than 60 ppm; and the balance being zirconium.

U.S. Pat. No. 5,560,799 discloses the zirconium alloy, which comprises the following alloy composition.

niobium, in a range of 0.5 to 1.5 wt. %;

tin, in a range of 0.9 to 1.5 wt. %;

iron, in a range of 0.3 to 0.6 wt. %;

chromium, in a range of 0.005 to 0.2 wt. %;

carbon, in a range of 0.005 to 0.04 wt. %;

oxygen, in a range of 0.05 to 0.15 wt. %;

silicon, in a range of 0.005 to 0.15 wt. %; and the balance being of zirconium.

In this patent, the distance between the precipitates, Zr(Nb, Fe)2, Zr(Fe, Cr, Nb), and (Zr, Nb)3Fe, was limited to the range of 0.20 to 0.40 $\mu$m, and the volume fraction of the precipitate containing iron was limited to 60% in precipitates.

U.S. Pat. No. 4,992,240 discloses a zirconium alloy containing the elements tin, iron, chromium and niobium, comprising tin in a range of 0.4 to 0.2 wt. %, iron in a range of 0.2 to 0.4 wt, chromium in a range of 0.1 to 0.6 wt, niobium in a range of 0 to 0.5 wt. % and the balance zirconium.

Also, U.S. Pat. No. 4,963,323 discloses a corrosion resistant zirconium alloy for uses as a reactor fuel cladding material consisting essentially:

tin, in a range of 0.2 to 1.15 wt. %;

iron, in a range of 0.19 to 0.6 wt. %;

chromium, in a range of 0.07 to 0.4 wt. %;

the balance being of zirconium and incidental impurities.

CA 2,082,691 describes the zirconium alloy maintaining ductility to that of sponge zirconium and high corrosion resistance by adding bismuth in a range of 0.1 to 0.5 wt. % and niobium in a range of 0.1 to 0.5 wt. % (typically 0.1 to 0.3 wt. %).

The zirconium alloys are suitable for material used in fuel rod cladding because of the small capture cross section of thermal neutron and relatively good corrosion resistance at high temperature. For the present fuel rod cladding, Zircaloys with tin, iron, chromium, and nickel are being widely used for the fuel rod cladding in nuclear power plant.

However, considering the circumstances of the extended and high burn-up fuel, the use of Zircaloys as material for fuel rod cladding becomes limited due to enhanced corrosion and irradiation creep. Therefore, the development of an advanced zirconium alloy with high strength and corrosion resistance has been required.

We, the inventors of this invention, successfully developed a zirconium alloy with higher strength and superior corrosion resistance than the former existing Zircaloys through making changes in the kinds and amounts of alloying elements.

SUMMARY OF THE INVENTION

It is the objective of this invention to provide an advanced zirconium alloy with superior corrosion resistance and high strength, suitable for the material for fuel rod cladding, spacer grid, and other structural components in the reactor core of nuclear power plants.

DESCRIPTION OF THE PREFERRED EMBODIMENTS

In order to attain the above objective, the zirconium alloy according to the present invention includes niobium in a range of 0.05 to 0.3 wt. %; tin in a range of 0.8 to 1.6 wt. %; iron in a range of 0.25 to 0.4 wt. %; oxygen in a range of 600 to 1400 ppm; and an element selected from the group consisting of vanadium, tellurium, antimony(Sb), molybdenum, tantalum, and copper in a range of 0.05 to 0.20 wt. %.

The present invention will now be described in detail.

The zirconium alloy of this invention may be utilized as a material for fuel rod claddings, spacer grids, and other structural components in the reactor core of nuclear power plants. The composition of this zirconium alloy is shown in Table I.

TABLE I

| Alloy system | Nb (wt. %) | Sn (wt. %) | Fe (wt. %) | X* (wt. %) | O (ppm) | Zr + impurities |
|---|---|---|---|---|---|---|
| Zr—Nb—Sn—Fe—X | 0.05–0.3 | 0.8–1.6 | 0.2–0.4 | 0.05–0.2 | 600–1400 | the balance |

*X: a selected element from the group consisted of V, Te, Sb, Mo, Ta and Cu.

Mostly the corrosion acceleration and the irradiation creep and growth are the main concerns in high burn-up fuel cladding. These problems make it difficult for the zirconium alloy to be used as a material for fuel rod cladding. Therefore, this invention mainly aims at improving corrosion resistance of zirconium alloy. The neutron effect, manufacturing cost and workability were considered in selecting the alloying elements, then the effects of each alloying element on corrosion resistance, mechanical properties and creep behavior were evaluated in detail. And then, the alloy system for this invention and the amount of each of the alloying elements were also determined.

The above factors are described in detail as follows:

(1) Neutron Effect

Neutron absorption is the most important of the above factors. The alloying elements having high absorption cross section of neutron were excluded due to neutron inefficiency. Therefore, zirconium was selected as a base element in this invention. The neutron absorption of alloying elements added to base zirconium was also considered in this invention.

(2) Cost and Usefulness

The alloying elements need to be readily available at a reasonable cost. And they must be easily alloyed with zirconium. Vapor pressure of the elements is also considered in selecting the alloying elements.

(3) Corrosion Resistance

Corrosion of material used in the reactor core is a serious problem, as it is constantly in contact with high temperature and high pressure water. In the view of corrosion resistance, the valence compatibility between zirconium base and alloying elements should be considered. In general, a supervalent element is known to improve corrosion resistance. Also, the difference between ionic radius of zirconium base and those of alloying elements should be small. When there is a significant difference in the ionic radius, the local stress in the oxide accelerates the penetration of hydrogen and oxygen. The above mentioned factors are generally considered when selecting alloying elements. In this invention, niobium and tin are the major alloying elements, and iron, vanadium, molybdenum, tellurium, antimony, tantalum and copper were added to improve the corrosion resistance and strength.

(4) Effects of Major Alloying Elements (a) Niobium(Nb)

Niobium is known to stabilize β-phase of zirconium. It is said that corrosion resistance and workability of the material is improved when niobium less than 0.5 wt. % is added. But, it is also said that zirconium alloy has superior corrosion resistance when 1.0 wt. % of niobium is added. Niobium is known as a useful element when hydrogen uptake and strength are considered. Because the alloys containing high concentration of niobium are sensitive to heat treatment condition, niobium is added in the range of 0.05 to 0.3 wt. % in this invention.

(b) Tin(Sn)

Tin stabilizes α-phase of zirconium, and increases its strength. With a small amount of tin cannot attain the desired strength and creep resistance cannot be attained. When determining the optimal amount of tin, it is preferred that it be increased the corrosion resistance be increased. As the amount of tin is decreased to improve the corrosion resistance, other alloying elements need to be added in exchange to maintain the strength instead of tin. The amount of tin in this invention is in the range of 0.8 wt. % to 1.6 wt. %.

(C) Iron(Fe)

Iron is known to improve corrosion resistance. Iron decreases corrosion resistance when less than 0.18 wt. % or more than 0.6 wt. % is added. Inversely, iron improves the corrosion resistance when it is added in the range of 0.2 to 0.6 wt. %. Iron is known to have no relation to strength and creep behavior, but it have an effect on hydrogen uptake. In this invention, the amount of iron is added in the range of 0.05 to 0.4 wt. %.

(d) Vanadium(V)

Vanadium effectively improves strength and creep resistance, and has positive effect on hydrogen uptake. When less than 0.05 wt. % of vanadium is added, there is no effect on strength, creep resistance, or hydrogen uptake. When vanadium is added more than 1 wt. %, the corrosion resistance of this alloy decreases. Therefore, vanadium is preferred when added in a range of 0.05 to 0.2 wt. %.

(e) Molybdenum(Mo)

Molybdenum effectively improves strength and creep resistance. An amount less than 0.05 wt. % of molybdenum does not improve strength and creep resistance. An amount more than 0.5 wt. % decreases corrosion resistance and elongation. Therefore, molybdenum is preferred when added in a range of 0.05 to 0.2 wt. %.

(f) Tellurium(Te) and antimony(Sb)

Tellurium and antimony are known to improve corrosion resistance when added in a small amount, and has positive effects on hydrogen uptake. A small amount of antimony does not form the precipitate due to the high solubility of 1.9 wt. % in the zirconium. Antimony also increases the solubility of hydrogen. Therefore, tellurium and antimony are preferred when added in a range of 0.05 to 0.2 wt. %.

(g) Tantalum(Ta)

Tantalum is known to improve corrosion resistance, but when less than 0.01 wt. % is added there is no improvement in corrosion resistance, and when more than 0.4 wt. % is added corrosion resistance decreases. Furthermore, it is not preferable to add it in large amounts because of its high neutron absorption cross section(21 barn).

(h) Copper(Cu)

Copper improves corrosion resistance when added in small quantities. Corrosion resistance improves when copper, in a range of 0.05 to 0.2 wt. %, is added.

(i) Oxygen(O)

Oxygen in a range of 600 to 1400 ppm is added to improve its mechanical strength by the solid solution hardening. However, workability decreases when oxygen is added in large amounts.

The zirconium alloy with superior corrosion and high strength was fabricated in consideration of the above mentioned factors.

For the purposes of illustration the invention has been described by referring to specific examples, but the present invention is not limited by the preferred embodiments.

EXAMPLES

In total six kinds of zirconium alloys according to the present invention have been described, hereinafter. The manufacturing process and the preferred embodiments, also, have been described.

(I) Ingot Melting

The material with the composition shown in Table II was melted into a 200 g button form by vacuum arc remelting (VAR) method. This process is repeated 5 times to prevent the segregation and nonhomogeneous dispersion of alloying elements.

During the β-quenching process, the basketweave and parallel plate structure were formed in the cooled ingot. It was different from the dendrite structure, which is generally formed when manufacturing the large ingot. This may have resulted from the size of ingot being small and the cooling rate, high.

TABLE II

| Zirconium alloy | | Alloy composition | | | | | |
|---|---|---|---|---|---|---|---|
| No. | X* | Nb (wt. %) | Sn (wt. %) | Fe (wt. %) | X* (wt. %) | O (ppm) | Zr + impurities |
| 1 | V | 0.28 | 1.47 | 0.25 | 0.10 | 949 | the balance |
| 2 | Te | 0.20 | 1.43 | 0.25 | 0.14 | 503 | the balance |
| 3 | Sb | 0.19 | 1.32 | 0.24 | 0.08 | 775 | the balance |
| 4 | Mo | 0.25 | 1.52 | 0.23 | 0.11 | 751 | the balance |
| 5 | Ta | 0.20 | 1.52 | 0.23 | 0.11 | 885 | the balance |
| 6 | Cu | 0.22 | 1.47 | 0.26 | 0.11 | 994 | the balance |
| Zircaloy-4 | | — | 1.53 | 0.21 | — | 1250 | the balance |

*X: a selected element from the group consisted of V, Te, Sb, Mo, Ta and Cu.

(II) β-Heat Treatment

β-Heat treatment was performed by the solution treatment of ingot in β-region for homogenizing the alloy composition. The sample was heated at 1050° C. for 30 minutes, and then cooled in a water.

(III) Hot Rolling and Heat Treatment

After preheating the samples at 700° C. for 20 minutes, they were rolled by 70% of its thickness in one pass. The oxide scale which is formed in β-treating or hot rolling was removed with an acid pickling solution.

(IV) Cold Rolling and Heat Treatment

The sample was annealed at 700° C. for 2 hours to remove the remaining strain after hot rolling and to prevent the breakage of the sample, which may occur in cold working. The sample was first cold-rolled to reduce its thickness by 30%. After the first cold-rolling, the sample was annealed for recrystallization at 610° C. for 2 hours. The above process for annealing and cold-rolling was repeated three times. Final heat treatment was conducted at 480° C. for 3 hours.

Corrosion tests were performed in autoclave with an atmosphere of 360° C. of water and 400° C. of steam for 100 days. Corrosion rate was quantitatively estimated by measuring the weight gain of corroded sample. Tensile test was also conducted by hydraulic tester with the tensile specimen at room temperature. Results of corrosion and tensile tests are shown in the following Table III.

TABLE III

| | Corrosion test ($mg/dm^2$) | | Test of tensile strength (MPa) | |
|---|---|---|---|---|
| No. of alloy | 360° C./water | 400° C./steam | Y.S/room temperature | UTS/room temperature |
| 1 | 33.4 | 76.7 | 532 | 733 |
| 2 | 35.5 | 62.8 | 542 | 726 |
| 3 | 37.3 | 64.4 | 620 | 850 |

TABLE III-continued

| | Corrosion test ($mg/dm^2$) | | Test of tensile strength (MPa) | |
|---|---|---|---|---|
| No. of alloy | 360° C./water | 400° C./steam | Y.S/room temperature | UTS/room temperature |
| 4 | 35.5 | 68.9 | 535 | 807 |
| 5 | 33.3 | 58.1 | 528 | 864 |
| 6 | 32.8 | 64.4 | 585 | 806 |
| Zircaloy-4 | — | 85.8 | 495 | 685 |

From the Table III, Zr—Nb—Sn—Fe—X alloys(in which X may be one of V, Te, Sb, Mo, Ta, and Cu), Nos. 1 to 6 in Table II, displayed smaller increase in weight (higher corrosion resistance) and higher mechanical strength than the conventional Zircaloy-4, in case of adding the alloying elements in a range, which was presented in this invention.

Effects of the Invention

From the above example, it was found that zirconium alloys of this invention displayed superior corrosion resistance and high mechanical strength. Therefore, the alloys of this invention can be utilized as fuel rod claddings, spacer grids and structural components, etc. in the reactor core of a nuclear power plant.

What is claimed is:

1. The zirconium alloy having high corrosion resistance and high strength, which comprises an alloy composition as follows:

niobium, in a range of 0.05 to 0.3 wt. %;

tin, in a range of 0.8 to 1.6 wt. %;

iron, in a range of 0.2 to 0.4 wt. %;

at least one element selected from the group consisting of tellurium (Te), antimony (Sb), molybdenum (Mo), tantalum(Ta), and copper(Cu), in a range of 0.05 to 0.20 wt. %;

oxygen, in a range of 600 to 1400 ppm; and the balance being zirconium.

2. The alloy as set forth in claim 1, the zirconium alloy is characterized in comprising the alloy composition as follows:

0.2 wt. % of niobium;

1.3 wt. % of tin;

0.2 wt. % of iron;

0.1 wt. % of at least one element selected from the group consisting of tellurium, antimony, molybdenum, tantalum, and copper;

oxygen, in a range of 600 to 1400 ppm; and the balance being zirconium.

3. The alloy of claim 1, consisting of the enumerated ingredients.

4. The alloy of claim 2, consisting of the enumerated ingredients.

* * * * *